US011421631B2

(12) United States Patent
Andersson et al.

(10) Patent No.: US 11,421,631 B2
(45) Date of Patent: Aug. 23, 2022

(54) METHOD FOR CONTROLLING AN INTERNAL COMBUSTION ENGINE ARRANGEMENT

(71) Applicant: VOLVO TRUCK CORPORATION, Gothenburg (SE)

(72) Inventors: Johan Carlén Andersson, Lund (SE); Fredrik Rahm, Hörby (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 17/312,333

(22) PCT Filed: Dec. 14, 2018

(86) PCT No.: PCT/EP2018/085054

§ 371 (c)(1),
(2) Date: Jun. 9, 2021

(87) PCT Pub. No.: WO2020/119929

PCT Pub. Date: Jun. 18, 2020

(65) Prior Publication Data

US 2022/0034283 A1 Feb. 3, 2022

(51) Int. Cl.
*F02M 26/33* (2016.01)
*F02M 26/04* (2016.01)
(Continued)

(52) U.S. Cl.
CPC ..... *F02M 26/33* (2016.02); *F02D 41/0065* (2013.01); *F02M 26/04* (2016.02); *F02M 2026/004* (2016.02)

(58) Field of Classification Search
CPC .. F02M 26/33; F02M 26/04; F02M 2026/004; F02M 31/13; F02M 26/05;
(Continued)

(56) References Cited

U.S. PATENT DOCUMENTS 5,675,968 A 10/1997 Katashiba et al.
6,164,071 A 12/2000 Shao et al.
(Continued)

FOREIGN PATENT DOCUMENTS

DE 102015221591 A1 5/2017
FR 3043730 A3 5/2017
WO 2018113988 A1 6/2018

OTHER PUBLICATIONS

International Search Report and Written Opinion dated Mar. 6, 2019 in corresponding International PCT Application No. PCT/EP2018/085054, 11 pages.

*Primary Examiner* — Xiao En Mo
(74) *Attorney, Agent, or Firm* — Venable LLP; Jeffri A. Kaminski

(57) ABSTRACT

The present invention relates to a method for controlling an internal combustion engine arrangement (100) connected to an exhaust gas aftertreatment system (200), wherein the method is arranged to control a gas heating device (122), as well as a gas feeding arrangement to direct a flow of intake air through the exhaust gas recirculation conduit (112) from the intake system to the exhaust system, the flow of intake air being directed through the gas heating device before the intake air enters the exhaust gas aftertreatment system, in response to determining a requested start of the internal combustion engine to heat the aftertreatment system before starting the engine.

16 Claims, 4 Drawing Sheets

(51) Int. Cl.
*F02D 41/00* (2006.01)
*F02M 26/00* (2016.01)

(58) Field of Classification Search
CPC ..... F02M 26/34; F02M 26/35; F02M 31/042; F02D 41/0065; F02D 41/0255; F01N 3/2006; F01N 3/22; F01N 3/306; F01N 3/32; F01N 3/323; F02B 37/168
See application file for complete search history.

(56) References Cited

U.S. PATENT DOCUMENTS

| | | | | |
|---|---|---|---|---|
| 6,324,846 | B1 | 12/2001 | Clarke | |
| 2008/0276603 | A1 | 11/2008 | Winsor | |
| 2009/0090329 | A1* | 4/2009 | Wang | F02D 41/0065 123/305 |
| 2009/0223205 | A1* | 9/2009 | Grissom | F01N 3/0256 60/303 |
| 2013/0111898 | A1 | 5/2013 | Dale | |
| 2015/0176536 | A1 | 6/2015 | Lutz et al. | |
| 2016/0153332 | A1 | 6/2016 | Pappenheimer et al. | |
| 2017/0114734 | A1* | 4/2017 | Weiss | F01L 1/047 |
| 2018/0340480 | A1* | 11/2018 | Mehta | F01N 3/2013 |
| 2019/0195106 | A1* | 6/2019 | Faizi | F01N 3/208 |
| 2021/0404362 | A1* | 12/2021 | Salemme | F02B 33/443 |

* cited by examiner

METHOD FOR CONTROLLING AN INTERNAL COMBUSTION ENGINE ARRANGEMENT

CROSS-REFERENCE TO RELATED APPLICATIONS

This application is a U.S. National Stage application of PCT/EP2018/085054, filed Dec. 14, 2018, and published on Jun. 18, 2020, as WO 2020/119929 A1, all of which is hereby incorporated by reference in its entirety.

TECHNICAL FIELD

The present invention relates to a method for controlling an internal combustion engine arrangement. The invention also relates to an internal combustion engine arrangement. The invention is applicable on vehicles, in particularly medium and heavy duty vehicles commonly referred to as trucks. Although the invention will mainly be described in relation to a truck, it may also be applicable for other type of vehicles.

BACKGROUND

Engine exhaust aftertreatment system (EATS) of vehicles function to reduce exhaust emissions, including oxides of Nitrogen (NOx). The EATS operates at its best after reaching a predetermined temperature. Hence, the EATS should preferably be relatively warm to function as desired. During for example cold starts of the internal combustion engine, when the vehicle has been stationary for some period of time, the EATS may not be sufficiently heated up and thus not functioning as desired.

There is thus a desire to be able to heat up the EATS more rapidly.

SUMMARY

The present disclosure describes a method which at least partially overcomes the above described deficiencies. This is achieved by a method according to claim 1.

According to a first aspect, there is provided a method for controlling an internal combustion engine arrangement connected to an exhaust gas aftertreatment system, the internal combustion engine arrangement comprising an internal combustion engine comprising a plurality of combustion cylinders; an intake system arranged in upstream fluid communication with the internal combustion engine and configured to feed intake air into the plurality of combustion cylinders; an exhaust system arranged in downstream fluid communication with the internal combustion engine and configured to convey exhaust gas away from the internal combustion engine to the exhaust gas aftertreatment system; an exhaust gas recirculation system comprising an exhaust gas recirculation conduit connected between the intake system and the exhaust system, wherein the internal combustion engine arrangement further comprises a gas feeding arrangement and a gas heating device, each arranged in fluid communication with the exhaust gas recirculation conduit, wherein the method comprises: determining a requested start of the internal combustion engine; controlling start up of the gas heating device for initiating heating of gas fed there through; and controlling the gas feeding arrangement to direct a flow of intake air through the exhaust gas recirculation conduit from the intake system to the exhaust system, the flow of intake air being directed through the gas heating device before the intake air enters the exhaust gas aftertreatment system.

The exhaust gas recirculation system, which is also known as an EGR system is in normal operation arranged to direct exhaust gas, conveyed from the internal combustion engine, from the exhaust system and back to the intake system. The exhaust gas recirculation conduit should thus be construed as the conduit which directs the exhaust gas from the exhaust system to the intake system.

The wording "gas feeding arrangement" should be construed as an arrangement which is capable of directing intake air through the exhaust gas recirculation conduit from the intake system to the exhaust system. Such gas feeding arrangement may e.g. comprise a pump which is positioned somewhere in the internal combustion engine arrangement. The gas feeding arrangement may, for example, comprise a fan arranged to blow intake air from the intake system to the exhaust system, or it may comprise some type of suction arrangement configured to suck intake air from the intake system. Thus, the gas feeding arrangement can be arranged in the intake system, in the exhaust system, or in the exhaust gas recirculation system. The latter alternative will be described in further detail below.

Moreover, the wording "gas heating device" should be construed as a device which heats the intake air. The gas heating device may be arranged at different positions of the internal combustion engine arrangement depending on which parts it may be desirable to heat up. For example, the gas heating device may be arranged in the intake system. At such position, the internal combustion engine, a turbo arrangement, as well as the exhaust gas aftertreatment system can be heated by means of the heated flow of intake air. However, if there is a desire to heat only the exhaust gas aftertreatment system, the gas heating device can be positioned in the exhaust system, or in fluid communication between the exhaust system and the exhaust gas aftertreatment system. The gas heating device may be formed by an intake gas heater positioned in the intake system and turned on before ignition when twisting the key.

Moreover, the requested start of the internal combustion engine may be determined in a number of ways. For example, a requested start may be determined by preprogramming to start the vehicle in the morning. It may also be determined by initiating turning the key in the ignition or pressing a start button to start the internal combustion engine. As a still further example, the vehicle may be a hybrid vehicle having an alternative source of propulsion, such as e.g. an electric motor. The requested start may in such case be determined by driving the vehicle using the alternative source of propulsion, wherein it is determined that the internal combustion engine needs to be started for assisting in propelling the vehicle.

The inventors of the present disclosure have realized that by controlling the flow of intake air through the exhaust gas recirculation system, from the intake system to the exhaust system, while at the same time heating the intake air, parts of the internal combustion engine arrangement as well as the exhaust gas aftertreatment system can be heated up prior to start up of the internal combustion engine.

An advantage is thus that a reduced time period for heating the exhaust gas aftertreatment system is achieved. Hence, the exhaust gas aftertreatment system will be heated more rapidly which is beneficial during e.g. cold-start of the internal combustion engine, as the exhaust gas aftertreatment system will be more rapidly at full operation. This will thus reduce exhaustion of harmful emissions during e.g. cold-start.

Moreover, an advantageous application is for hybrid vehicles which are controllably operated by the internal combustion engine as well as by an alternative propulsion source, such as an electric motor. When operated by the electric motor, the internal combustion engine, as well as the exhaust gas aftertreatment system may have been cooled down to such an extent that start up thereof will generate harmful emissions. Pre-heating according to the above method may enable the exhaust gas aftertreatment system to be provided at a suitable operating temperature at start up. Thereafter, the internal combustion engine can be started up for propelling the vehicle.

According to an example embodiment, the steps of controlling start up of the gas heating device and controlling the gas feeding arrangement to direct the flow of intake air to the exhaust system may be executed prior to starting the internal combustion engine. Thus, the vehicle could be either turned off or propelled by an alternative source of propulsion.

The wording "starting the internal combustion engine" should thus be understood such that the cylinders of the internal combustion engine are initiating their combustion process.

According to an example embodiment, the method may further comprise the step of: receiving a signal indicative of a temperature level of the internal combustion engine arrangement; and controlling the gas feeding arrangement proportionally to the temperature level.

It should thus here be readily understood that the temperature of the gas flow through the gas feeding arrangement increases when the rotational speed of the gas feeding arrangement decreases, and vice versa. Thus, increasing the power level, i.e. increasing the flow velocity through the gas feeding arrangement will reduce the temperature of the gas flow from the gas feeding arrangement. The power level can, for an electrically controlled gas feeding arrangement be controlled by controlling the supply of voltage/current. The temperature level may, for example, be a measured ambient temperature of the internal combustion engine arrangement, the actual engine temperature, the temperature level of the engine coolant, the temperature of the EATS, etc. The temperature level may also relate to mapped temperature levels.

An advantage is thus that the gas feeding device is controlled based on the needed/desired temperature level. Hence, if the temperature level is determined to be relatively high, the temperature level of the gas from the gas feeding arrangement can be relatively low, wherein the power level for the gas feeding arrangement can be increased, i.e. the flow velocity through the gas feeding arrangement can be increased for supplying a lower gas temperature. Likewise, if the temperature is determined to be low, the needed/desired temperature level is higher, wherein the gas feeding arrangement can be controlled to reduce its power for increasing the temperature level of the gas flow, i.e. reduce the flow velocity through the gas feeding arrangement. Accordingly, thermal management is improved, and the gas feeding arrangement is controlled for sufficiently heating the internal combustion engine and its components.

According to an example embodiment, the method may further comprise the steps of: determining a temperature level of the internal combustion engine arrangement; comparing the temperature level with a predetermined temperature threshold limit; and controlling start up of the gas heating device and controlling the gas feeding arrangement to direct the flow of intake air to the exhaust system only if the temperature level is below the predetermined temperature threshold limit.

The temperature of the internal combustion engine arrangement may be determined by means of e.g. a temperature sensor or equivalent. Other alternatives are also conceivable.

If the internal combustion engine arrangement is turned off, but still sufficiently warm, the gas heating device does not need to be started up. Also, there may be no need of controlling the gas feeding arrangement to direct the flow of intake air to the exhaust system.

According to an example embodiment, the temperature level of the internal combustion engine arrangement may correspond to a temperature level of the internal combustion engine, and the predetermined temperature threshold limit corresponds to a predetermined engine temperature level.

According to an example embodiment, the temperature level of the internal combustion engine arrangement may correspond to a temperature level of the exhaust gas aftertreatment system, and the predetermined temperature threshold limit corresponds to a predetermined exhaust gas aftertreatment system temperature threshold limit. Hence, if the exhaust gas aftertreatment system is sufficiently warm, the need of further pre-heating may be superfluous.

According to an example embodiment, the temperature level of the internal combustion engine arrangement may correspond to a temperature level in the exhaust gas recirculation conduit, and the predetermined temperature threshold limit corresponds to a predetermined temperature threshold limit for the exhaust gas recirculation conduit.

According to an example embodiment, the gas feeding arrangement may comprise a gas flow pump. As indicated above, such gas flow pump can be positioned at substantially any desirable position of the internal combustion engine arrangement. However, and preferably, the gas flow pump may be an exhaust gas recirculation pump (EGR-pump) which is positioned in the exhaust gas recirculation system.

According to an example embodiment, the gas flow pump may be a bidirectional gas flow pump arranged to controllably direct gas flow from the exhaust system to the intake system, and from the intake system to the exhaust system. The gas flow pump can thus have the dual functionality of directing intake air from the intake system to the exhaust system, as well as directing exhaust gas from the exhaust system to the intake system.

The bidirectional gas flow pump is thus capable of pumping a flow of exhaust gas to the intake system as well as reversing the pump direction in order to feed intake air from the intake system to the to the exhaust system.

According to an example embodiment, the gas feeding arrangement may comprise a valve unit, the valve unit being controllable to direct gas flow from the exhaust system to the intake system, and from the intake system to the exhaust system. Hereby, the gas feeding arrangement can be provided with a gas flow pump which operates in only one direction, wherein the flow is instead controlled by means of controlling the valve unit. The gas feeding arrangement preferably comprises a first conduit arranged to direct intake air from the intake system to the exhaust system, and a second conduit arranged to direct exhaust gas from the exhaust system to the intake system.

According to an example embodiment, the gas feeding arrangement may comprise one of an additional electrically controlled supercharger or an additional electrically controlled turbocharger. An advantage of using such gas feeding arrangement, especially when positioned upstream the gas heating device on the intake side, is that also the internal combustion engine will be heated. Also, a supercharger and a turbocharger are substantially unaffected by high temperature gas flows. Thus, flow with relatively high gas temperature is allowed when using one of these gas feeding arrangements. The additional supercharger and additional turbocharger should thus be understood as additional components in relation to the supercharger/turbocharger already present on the vehicle engine.

According to an example embodiment, the gas heating device may be an intake air heater positioned in the intake system. According to an example embodiment, the gas heating device may be positioned in the exhaust gas recirculation system in fluid communication between the intake system and the exhaust system. According to an example embodiment, the gas heating device may be positioned in the exhaust system. Hence, as described above, the gas heating device can be arranged at a suitable position depending on the specific application.

According to a second aspect, there is provided an internal combustion engine arrangement connected to an exhaust gas aftertreatment system, the internal combustion engine arrangement comprising an internal combustion engine comprising a plurality of combustion cylinders; an intake system arranged in upstream fluid communication with the internal combustion engine and configured to feed intake air into the plurality of combustion cylinders; an exhaust system arranged in downstream fluid communication with the internal combustion engine and configured to convey exhaust gas away from the internal combustion engine to the exhaust gas aftertreatment system; an exhaust gas recirculation system comprising an exhaust gas recirculation conduit connected between the intake system and the exhaust system, wherein the internal combustion engine arrangement further comprises a gas feeding arrangement and a gas heating device, each arranged in fluid communication with the exhaust gas recirculation conduit; and a control unit connected to the gas feeding arrangement and the gas heating device, characterized in that the control unit is configured to: determine a requested start of the internal combustion engine; transmit a start up signal to the gas heating device for start up of the gas heating device; and transmit a control signal to the gas feeding arrangement to direct a flow of intake air through the exhaust gas recirculation conduit from the intake system to the exhaust system, the flow of intake air being directed through the gas heating device before the intake air enters the exhaust gas aftertreatment system.

The control unit may include a microprocessor, microcontroller, programmable digital signal processor or another programmable device. The control unit may also, or instead, include an application specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device.

Effects and features of the second aspect are largely analogous to those described above in relation to the first aspect.

According to a third aspect, there is provided a vehicle comprising an internal combustion engine arrangement according to the above described second aspect.

According to an example embodiment, the vehicle may comprise an alternative source of propulsion. Such alternative source of propulsion should thus be construed as a prime mover different from the internal combustion engine arrangement. Such prime mover may preferably be operated when driving the vehicle with the internal combustion engine arrangement turned off. The alternative source of propulsion may for example be an electric motor receiving electrical power from a battery.

According to a fourth aspect, there is provided a computer program comprising program code means for performing the steps described above in relation to the first aspect when the program is run on a computer.

According to a fifth aspect, there is provided a computer readable medium carrying a computer program comprising program means for performing the steps described above in relation to the first aspect when the program means is run on a computer.

Effects and features of the third, fourth and fifth aspects are largely analogous to those described above in relation to the first aspect.

Further features of, and advantages with, will become apparent when studying the appended claims and the following description. The skilled person will realize that different features of the present disclosure may be combined to create embodiments other than those described in the following, without departing from the scope of the present disclosure.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS

Figure 1:
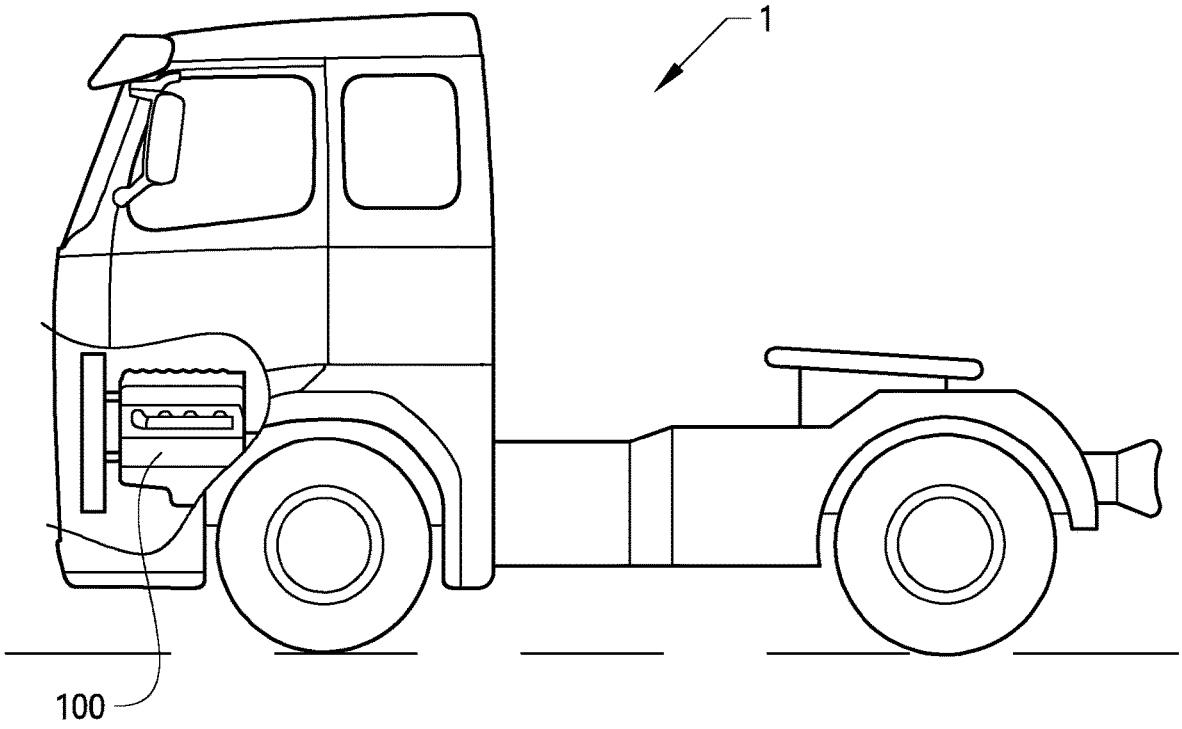
FIG. 1 is a lateral side view illustrating an example embodiment of a vehicle in the form of a truck.

The present invention will now be made more fully detailed hereinafter with reference to the accompanying drawings, in which exemplary embodiments are shown. The invention may, however, be embodied in many different forms and should not be construed as limited to the embodiments set forth herein; rather, these embodiments are provided for thoroughness and completeness. Like reference character refer to like elements throughout the description.

With particular reference to FIG. 1, there is provided a vehicle 1 in the form of a truck. The vehicle 1 comprises a prime mover 100 in the form of an internal combustion engine arrangement 100. The internal combustion engine arrangement 100 may preferably be fueled by e.g. a conventional fuel such as diesel, although other alternatives are conceivable. The internal combustion engine 100 is preferably operated in a four stroke fashion, i.e. operated by an intake stroke, a compression stroke, a combustion stroke, and an exhaust stroke.

Figure 2:
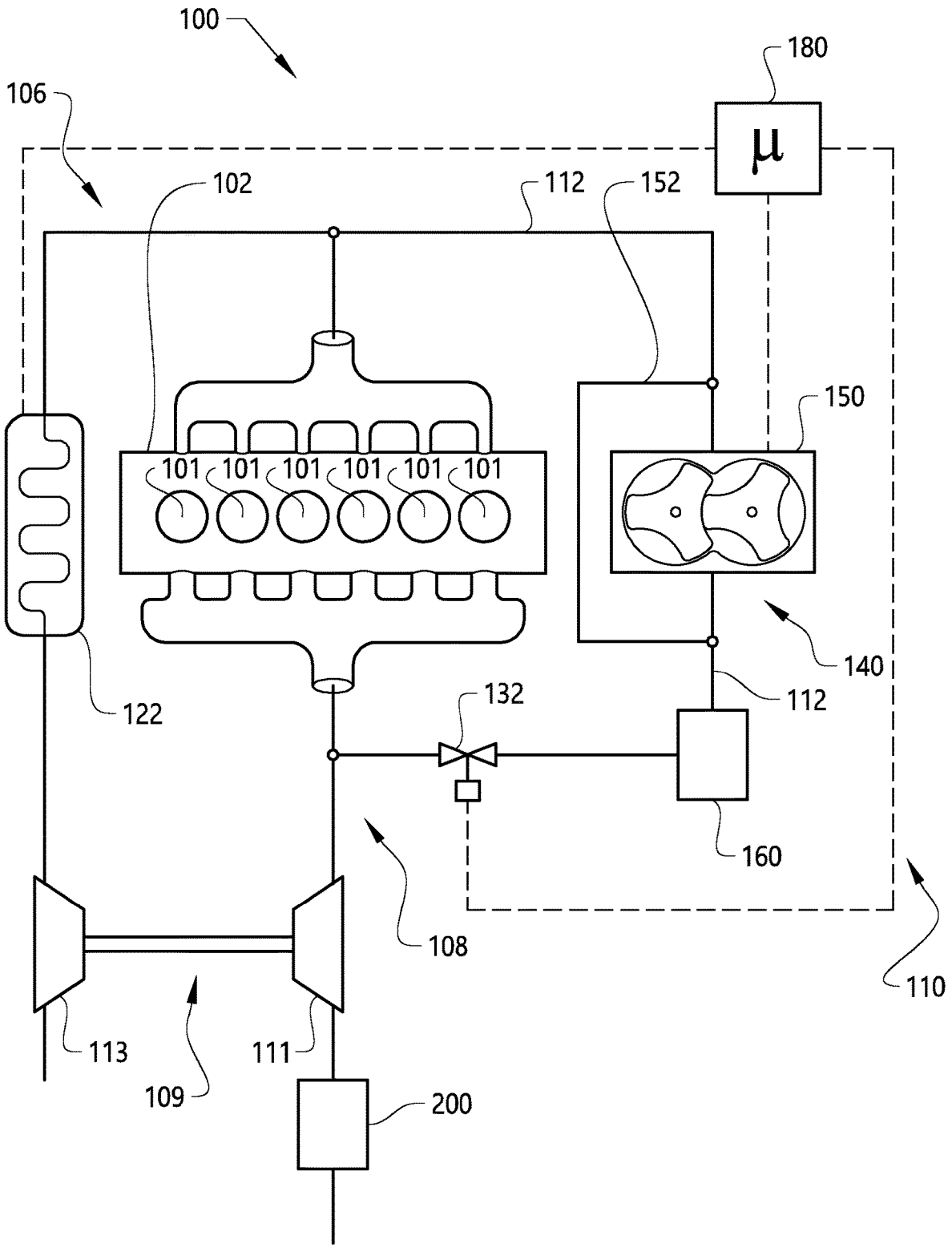
FIG. 2 is a schematic illustration of an internal combustion engine arrangement according to an example embodiment.

Reference is made to FIG. 2, which schematically illustrates the internal combustion engine arrangement 100 according to an example embodiment. The internal combustion engine arrangement 100 is connected to an exhaust gas aftertreatment system 200. As can be seen, the internal combustion engine arrangement 100 comprises an internal combustion engine 102 comprising a plurality of combustion cylinders 101. The internal combustion engine arrangement 100 further comprises an intake system 106, through which intake air is fed into the combustion cylinders 101, and an exhaust system 108 arranged downstream the combustion cylinders 101 for receiving generated exhaust gas from the combustion cylinders 101. The exhaust system 108 is in turn connected to a turbocharger 109. In detail, the turbocharger 109 comprises a turbine 111 in fluid communication with the exhaust system 108 and a compressor 113 in fluid communication with the intake system 106.

Moreover, the internal combustion engine arrangement 100 comprises a gas heating device 122 which is arranged to heat intake air. The gas heating device 122 is depicted as positioned in the intake system 106 upstream an intake to the combustion cylinders 101. However, the gas heating device 122 can be arranged at other positions of the internal combustion engine arrangement 100 as is readily understood by the skilled person. The gas heating device 122 in FIG. 2 is illustrated in the form of an intake heater commonly used on vehicles fueled by diesel.

The internal combustion engine arrangement 100 further comprises an exhaust gas recirculation system (EGR system) 110. The EGR system 110 comprises an exhaust gas recirculation conduit (EGR conduit) 112 connected between the intake system 106 and the exhaust system 108. The EGR system 110 comprises a gas feeding arrangement 140. As will be described further below, the gas feeding arrangement 140 is arranged to selectively direct either intake air from the intake system to the exhaust system, or to direct exhaust gas from the exhaust system to the intake system, depending on current mode of operation of the internal combustion engine arrangement 100. In the example embodiment depicted in FIG. 2, the gas feeding arrangement 140 comprises a bidirectional gas flow pump 150, which is preferably arranged as a bidirectional EGR pump 150. The bidirectional gas flow pump 150 can be arranged to direct air/gas in both directions between the intake system and the exhaust system. As also illustrated, the EGR system 110 comprises a by-pass conduit 152 for being able to by-pass the bidirectional gas flow pump 150. Although not depicted, the by-pass conduit 152 preferably comprises a by-pass valve.

The gas feeding arrangement 140 may comprise other arrangements instead the bidirectional gas flow pump 150, as will be described in further detail below with reference to FIG. 3.

During operation of the internal combustion engine 102 the EGR system 110 may be operated by a control unit 180. The control unit 180 is thus preferably arranged to transmit control signals to the gas feeding arrangement 140 for operation thereof, as well as providing power to the gas feeding arrangement 140. The control unit 180 is also preferably connected to the gas heating device 122 for controlling operation thereof, and for providing power thereto.

As is further depicted in FIG. 2, the EGR system 110 comprises an EGR valve 132 and an EGR cooler 160. In FIG. 2, both the EGR valve 132 as well as the EGR cooler 160 is arranged in fluid communication between the gas feeding arrangement 140 and the exhaust system 108. The EGR valve 132 is preferably also connected to the control unit 180.

Figure 4:
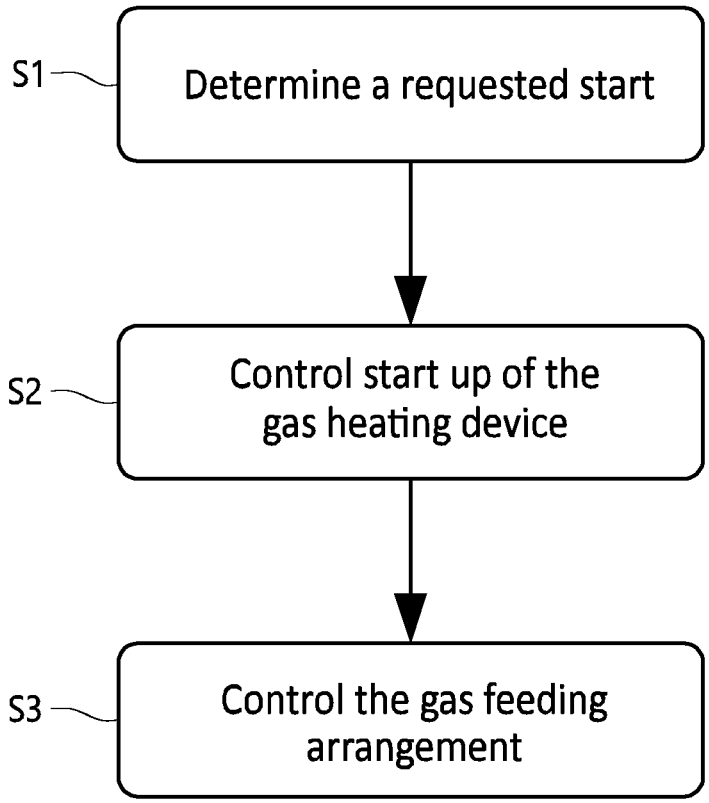
FIG. 4 is a flow chart of a method for controlling an internal combustion engine arrangement according to an example embodiment.

Reference is now made to FIG. 2 in combination with FIG. 4 for description of how to operate the internal combustion engine arrangement 100 before start up of the cylinders 101 of the internal combustion engine 102.

Firstly, a requested start of the internal combustion engine 102 is determined S1. Accordingly, at this point, the internal combustion engine 102 is turned off, i.e. in a non-operating state, and it is determined that the internal combustion engine 102 is about to be operated. This can be determined by means of a pre-programmed start up of the internal combustion engine arrangement, for example that a driver of the vehicle 1 has pre-programmed that he/she will start operation at a specific time in the morning. The requested start may also be determined by e.g. operating the vehicle by an electric motor with the engine turned off, wherein start of the internal combustion engine is expected due to e.g. low battery capacity of a battery operating the electric motor, or that a steep hill is expected at which operation of the internal combustion engine is needed.

When it has been determined that internal combustion engine is about to be started, the control unit 180 controls S2 the gas heating device 122 to be started up. Hereby, the gas heating device 122 initiates heating of gas fed there through, i.e. heats up intake gas conveyed there through. At the same time, or at least approximately the same time, the control unit 180 also controls S3 the gas feeding arrangement 140 to direct a flow of intake air, which has been heated by the gas heating device 122, from the intake system 106 to the exhaust system 108 via the EGR conduit 112.

Accordingly, before the internal combustion engine 102 has been turned on, warm air has been conveyed to the exhaust system 108. In particular, the heated intake air has been conveyed through the exhaust gas aftertreatment system 200. The exhaust gas aftertreatment system 200 will thus be heated and in turn more rapidly become operational.

Furthermore, the power level of the gas feeding arrangement can be controlled based on feedback of the temperature level downstream the gas heating device 122, or based on feedback of e.g. ambient temperature, EATS temperature, etc. In detail, the flow velocity through the gas feeding arrangement can be controlled based on a feedback of the temperature level. Hereby, if there is a desire to provide a high gas temperature, due to e.g. low temperature downstream the gas heating device 122 and/or low ambient temperature/EATS temperature, the power level, that is, the flow rate, of the gas feeding arrangement can be reduced to supply a relatively high temperature gas flow downstream the gas feeding arrangement.

The method described above in relation to FIGS. 2 and 4 should preferably be executed if the temperature level of the internal combustion engine arrangement 100, or the temperature of the exhaust gas aftertreatment system 200, is below a predetermined temperature threshold limit. Hence, the method is most advantageous if the internal combustion engine arrangement 100 is relatively cold.

Figure 3:
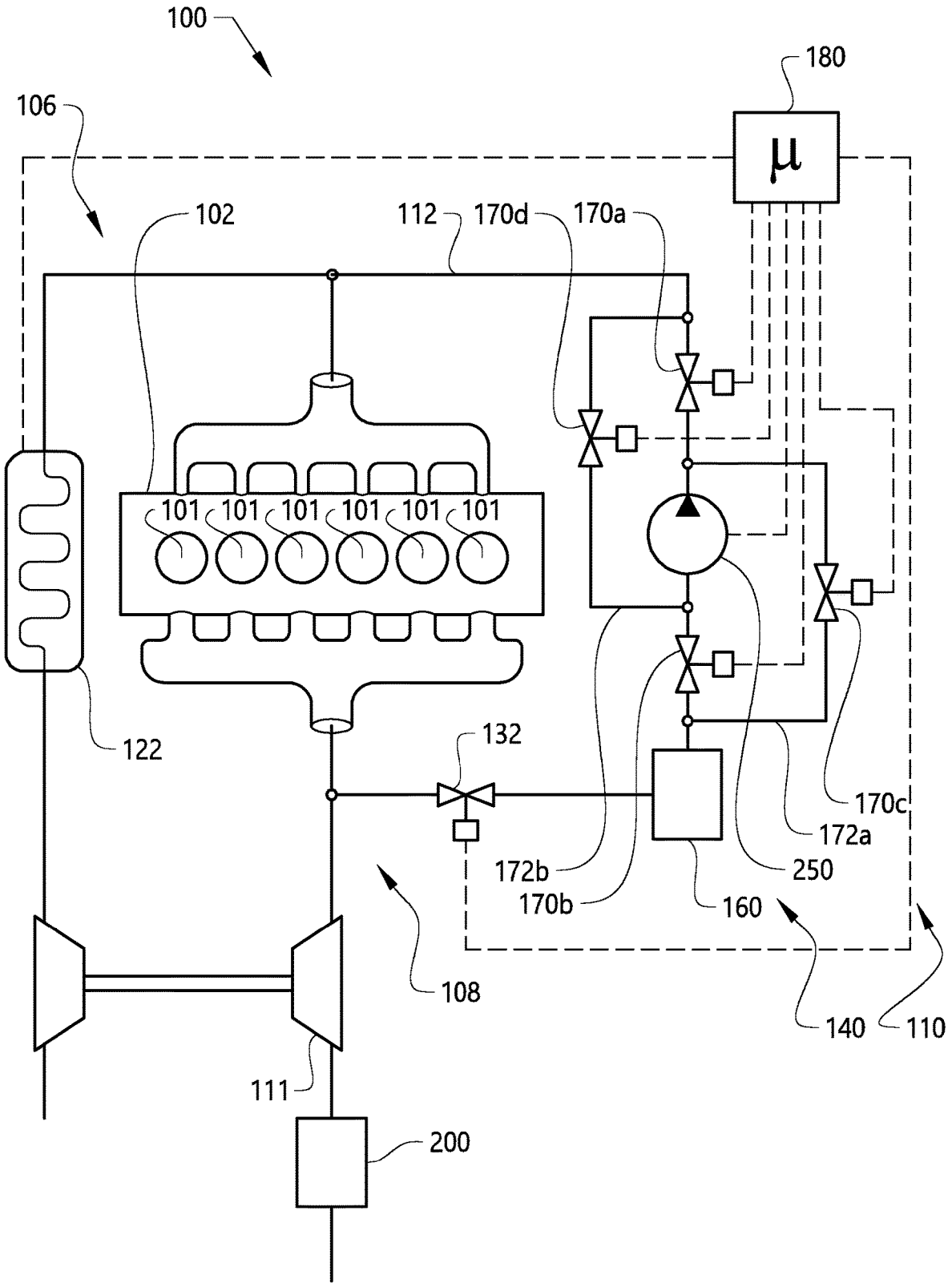
FIG. 3 is a schematic illustration of an internal combustion engine arrangement according to an example embodiment.

Reference is now made to FIG. 3 illustrating the internal combustion engine arrangement 100 according to another example embodiment. The example embodiment depicted in FIG. 3 can be operated in the same way as described above for the embodiment depicted in FIG. 2. Thus, the method described in relation to FIG. 4 is equally applicable for the internal combustion engine arrangement 100 in FIG. 3. Features of FIG. 3 which are similar to the embodiment in FIG. 2 will not be described unless so explicitly indicated.

In the embodiment of FIG. 3 the EGR system 110 operates in a quite different manner as compared to the EGR system 110 of FIG. 2. Instead of having a bidirectional flow pump 150, the gas feeding arrangement 140 of FIG. 3 comprises a gas flow pump 250 which is only capable of operating in a single direction corresponding to the pumping direction of normal EGR mode, i.e. from the exhaust system 108 to the intake system 106. In other words, the gas feeding arrangement 140 can only draw exhaust gas towards the intake system 106. In order to provide for the reversed gas flow, i.e. drawing air from the intake system 106 to the exhaust system 108, valves 170*a-d* are provided.

The valves 170*a-d*, being connected to the control unit 180, are configured be actuated to re-direct the flow from the gas feeding arrangement 140 from its normal feed direction to a reversed flow direction.

As stated above, the gas flow pump 250 of FIG. 3 is running in the same first direction also for reversing the flow prior to starting of the internal combustion engine 102. Control of the valves 170*a-d* is instead required to change the gas flow direction through the EGR conduit 112.

A first valve 170*a* arranged on a first side of the pump 250 facing the intake system 106 and a second valve 170*b* is arranged on a second side of the pump 250 facing the exhaust system 108. The first and second valves 170*a-b* are therefore arranged on opposite sides of the pump 250. A first bypass line 172*a* is connected to the EGR conduit 112 and arranged to bypass the second valve 170*b*, and a third valve 170*c* is arranged in the first bypass line 172*a*. A second bypass line 172*b* is connected to the EGR conduit 112 and arranged to bypass the first valve 170*a*, and a fourth valve 170*d* is arranged in that second bypass line 172*b*.

During normal EGR mode, i.e. when directing exhaust gas from the exhaust system 108 to the intake system 106, the first and second valves 170*a-b* are open, while the third and fourth valves 170*c-d* are closed. Exhaust gas will thereby be drawn from the exhaust system 108 through the pump 250 and into the intake system 106 via the EGR conduit 112. Before engine start up, the valves 170*a-d* are controlled in opposite manner, i.e. the first and second valves 170*a-b* are closed, while the third and fourth valves 170*c-d* are open. The pump 250 will in this mode draw air from the intake system 106, into the EGR conduit 112, and further through the turbine 111 and into the exhaust gas aftertreatment system 200.

It should be noted that the third valve 170*c* could be replaced by a non-return valve, which thereby would reduce the required control of the system. Further, it should be noted that bypass lines 172*a-b* could also be used to bypass the pump 250, as explained earlier with respect to the bypass conduit 152. Other valve configurations are also possible within the context of this application, as long as they allow for a change in flow direction through the EGR conduit 112 while the gas flow pump 250 is running in only one direction.

It is to be understood that the present disclosure is not limited to the embodiments described above and illustrated in the drawings; rather, the skilled person will recognize that many changes and modifications may be made within the scope of the appended claims.

The invention claimed is:

1. A method for controlling an internal combustion engine arrangement connected to an exhaust gas aftertreatment system, the internal combustion engine arrangement comprising an internal combustion engine comprising a plurality of combustion cylinders; an intake system arranged in upstream fluid communication with the internal combustion engine and configured to feed intake air into the plurality of combustion cylinders; an exhaust system arranged in downstream fluid communication with the internal combustion engine and configured to convey exhaust gas away from the internal combustion engine to the exhaust gas aftertreatment system; an exhaust gas recirculation system comprising an exhaust gas recirculation conduit connected between the intake system and the exhaust system, wherein the internal combustion engine arrangement further comprises a gas feeding arrangement and a gas heating device, each arranged in fluid communication with the exhaust gas recirculation conduit, the method comprising:

determining a requested start of the internal combustion engine;

controlling start up of the gas heating device for initiating heating of gas fed there through; and controlling the gas feeding arrangement to direct a flow of intake air through the exhaust gas recirculation conduit from the intake system to the exhaust system, the flow of intake air being directed through the gas heating device before the intake air enters the exhaust gas aftertreatment system.

2. The method according to claim 1, wherein the steps of controlling start up of the gas heating device and controlling the gas feeding arrangement to direct the flow of intake air to the exhaust system is executed prior to starting the internal combustion engine.

3. The method according to claim 1, further comprising the step of:

receiving a signal indicative of a temperature level of the internal combustion engine arrangement; and controlling the gas feeding arrangement proportionally to the temperature level.

4. The method according to claim 1, further comprising the steps of:

determining a temperature level of the internal combustion engine arrangement;

comparing the temperature level with a predetermined temperature threshold limit; and controlling start up of the gas heating device and controlling the gas feeding arrangement to direct the flow of intake air to the exhaust system only if the temperature level is below the predetermined temperature threshold limit.

5. The method according to claim 4, wherein the temperature level of the internal combustion engine arrangement corresponds to a temperature level of the internal combustion engine, and the predetermined temperature threshold limit corresponds to a predetermined engine temperature level.

6. The method according to claim 4, wherein the temperature level of the internal combustion engine arrangement corresponds to a temperature level of the exhaust gas aftertreatment system, and the predetermined temperature threshold limit corresponds to a predetermined exhaust gas aftertreatment system temperature threshold limit.

7. The method according to claim 4, wherein the temperature level of the internal combustion engine arrangement corresponds to a temperature level in the exhaust gas recirculation conduit, and the predetermined temperature threshold limit corresponds to a predetermined temperature threshold limit for the exhaust gas recirculation conduit.

8. The method according to claim 1, wherein the gas feeding arrangement comprises a gas flow pump.

9. The method according to claim 8, wherein the gas flow pump is a bidirectional gas flow pump arranged to controllably direct gas flow from the exhaust system to the intake system, and from the intake system to the exhaust system.

10. The method according to claim 8, wherein the gas feeding arrangement comprises a valve unit, the valve unit being controllable to direct gas flow from the exhaust system to the intake system, and from the intake system to the exhaust system.

11. The method according to claim 1, wherein the gas feeding arrangement comprises one of an electrically controlled supercharger or an electrically controlled turbocharger.

12. The method according to claim 1, wherein the gas heating device is an intake air heater positioned in the intake system.

13. An internal combustion engine arrangement connected to an exhaust gas aftertreatment system, the internal combustion engine arrangement comprising an internal combustion engine comprising a plurality of combustion cylinders; an intake system arranged in upstream fluid communication with the internal combustion engine and configured to feed intake air into the plurality of combustion cylinders; an exhaust system arranged in downstream fluid communication with the internal combustion engine and configured to convey exhaust gas away from the internal combustion engine to the exhaust gas aftertreatment system; an exhaust gas recirculation system comprising an exhaust gas recirculation conduit connected between the intake system and the exhaust system, wherein the internal combustion engine arrangement further comprises a gas feeding arrangement and a gas heating device, each arranged in fluid communication with the exhaust gas recirculation conduit; and a control unit connected to the gas feeding arrangement and the gas heating device, characterized in that the control unit is configured to:

determine a requested start of the internal combustion engine;

transmit a start up signal to the gas heating device for start up of the gas heating device; and transmit a control signal to the gas feeding arrangement to direct a flow of intake air through the exhaust gas recirculation conduit from the intake system to the exhaust system, the flow of intake air being directed through the gas heating device before the intake air enters the exhaust gas aftertreatment system.

14. A vehicle comprising an internal combustion engine arrangement according to claim 13.

15. A computer program comprising program code for performing the steps of claim 1 when the program code is run on a computer.

16. A computer readable medium carrying a computer program comprising program means for performing the steps of claim 1 when the program means is run on a computer.

* * * * *